US006190075B1

(12) United States Patent
Lewis

(10) Patent No.: US 6,190,075 B1
(45) Date of Patent: Feb. 20, 2001

(54) TIRE BRUSH

(76) Inventor: Edward Lewis, 1600 Topping Ave., #3G, Bronx, NY (US) 10457

( * ) Notice: Under 35 U.S.C. 154(b), the term of this patent shall be extended for 0 days.

(21) Appl. No.: 09/635,363

(22) Filed: Aug. 10, 2000

Related U.S. Application Data

(63) Continuation-in-part of application No. 09/476,823, filed on Feb. 28, 2000.

(51) Int. Cl.[7] ..... A46B 11/00
(52) U.S. Cl. ..... 401/129; 401/126
(58) Field of Search ..... 401/118, 126, 401/127, 129; 15/130, 176.6

(56) References Cited

U.S. PATENT DOCUMENTS

| | | | | |
|---|---|---|---|---|
| 772,382 | * | 10/1904 | Sexton | 401/129 |
| 1,086,676 | * | 2/1914 | Linscott | 401/129 |
| 1,098,390 | * | 6/1914 | Lonskey | 401/129 |
| 1,455,158 | * | 5/1923 | Woodruff | 401/129 |
| 1,713,145 | * | 5/1929 | Perry | 401/129 |
| 2,362,251 | * | 11/1944 | Eggleton | 401/129 |
| 2,627,276 | * | 2/1953 | Eggleton | 401/129 |
| 2,633,845 | * | 4/1953 | Peretti | 401/129 |
| 3,895,877 | * | 7/1975 | Fomby | 401/126 |
| 4,301,567 | * | 11/1981 | Tucker | 15/130 |
| 5,572,761 | * | 11/1996 | Meyer | 15/130 |
| 5,617,605 | * | 4/1997 | Hoerner et al. | 15/130 |

* cited by examiner

*Primary Examiner*—Charles R. Eloshway
(74) *Attorney, Agent, or Firm*—Lieberman & Nowak, LLP

(57) ABSTRACT

A brush/container combination specifically designed for cleaning tires. A unique sealing disk prevents leakage while a tongue attached to the container cover accommodates the brush used in the tire cleaning operation.

1 Claim, 1 Drawing Sheet

TIRE BRUSH

RELATED APPLICATIONS

This application is a continuation-in-part application of application Ser. No. 09/476,823 filed on Feb. 28, 2000.

FIELD OF THE INVENTION

This invention relates to an application whereby a tire dressing liquid may be applied to the face of any tire. This devise further relates to a container specifically selected to house the liquid solution that will be used.

BACKGROUND OF THE INVENTION

Most conventional containers used for applying a tire cleaning solution are equipped with a spray dispenser that is troublesome to use. Such a dispenser takes too many pump actions to spray the tire completely and the slightest wind blows the spray on the vehicle and on the person using the dispenser. It is apparent therefore that the best dispenser for a tire cleaning solution would be in the form of a brush with an associated container.

Brush and container combinations are known in the prior art. For example, U.S. Pat. No. 772,382 describes a brush holder which also functions as a lid for a paint can or other container. Similar brush/container combinations are also shown in U.S. Pat. Nos. 1,086,626, 1,098,390 and 1,455,158.

Although such prior art brush/container combinations are known they suffer from several disadvantages including difficulty in use, cost and difficulty in manufacturing.

The present invention is intended to solve the problems inherent in the prior art and provide a unique and advanced brush/container combination specifically designed as a tire brush.

It is therefore the object of this invention to provide a brush applicator combined with a container of tire cleaning solution that will provide a quick and easy way to do tire dressing.

SUMMARY OF THE INVENTION

The present invention comprises a unique brush/container combination specifically designed for cleaning tires while being easy to use and easy to manufacture. A particular feature of the invention is a unique sealing disc which ensures that the container is tightly sealed while a tongue arrangement attached to the container cover accommodates the brush used in the tire cleaning.

DETAILED DESCRIPTION OF THE INVENTION

Figure 1:
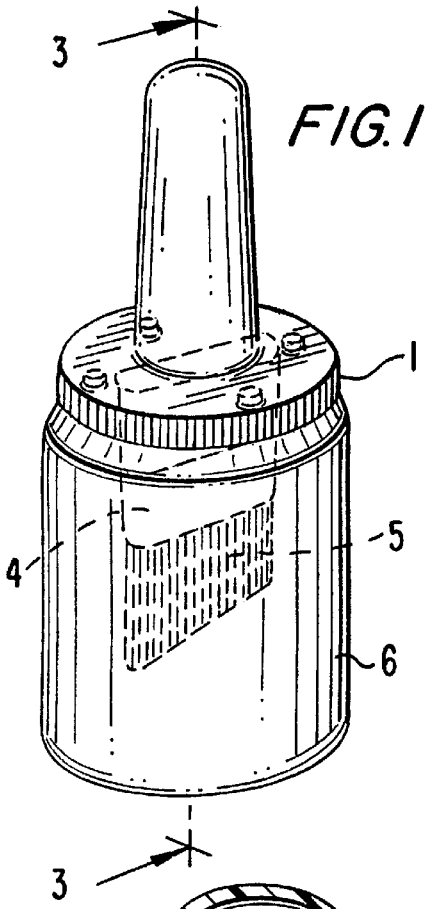
FIG. 1 shows a plan view of the present invention.

Referring now to FIG. 1, there is shown a view of the brush/container combination of the present invention. The handle is round, not flat, making for easy use. The cover is threaded for firm attachment to the container and the container is preferably made of clear plastic so that the level of liquid in the container can be readily seen by the user.

Figure 2:
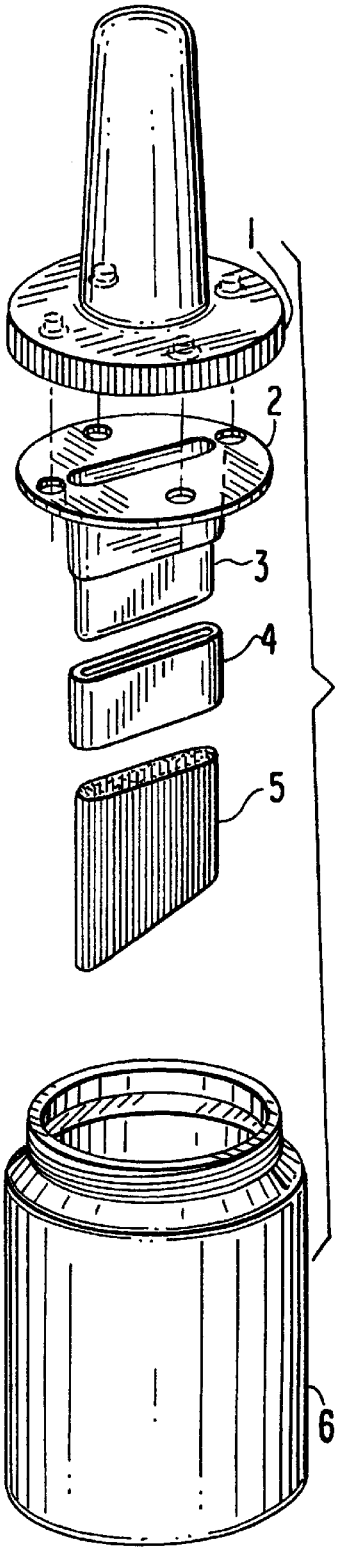
FIG. 2 shows an exploded view of the various components of the present invention.

FIG. 2 is an expanded view of the invention. Cover 1 has a plurality of protrusions on it's lower side which mate with the apertures in disc 2. Disc 2 is designed to provide a leak-proof seal for the container and also to serve as a base for tongue 3.

Tongue 3 is designed to accommodate collar 4 which also holds bristles 5. Tongue 3 can be of different lengths, depending on the length of the bristles and the depth of container 6. What is important is that the bristles and tongue combination are sufficient in length so that the end of the bristles reach the bottom of the container 6.

The bristles are preferably slanted which will help prevent putting the tire cleaning solution on the tire rim and on the tire treads. The size of the brush is also important to avoid getting the tire cleaning solution on the rim and on the treads. The brush is preferably 2½ inches wide and 2 inches long.

Figure 3:
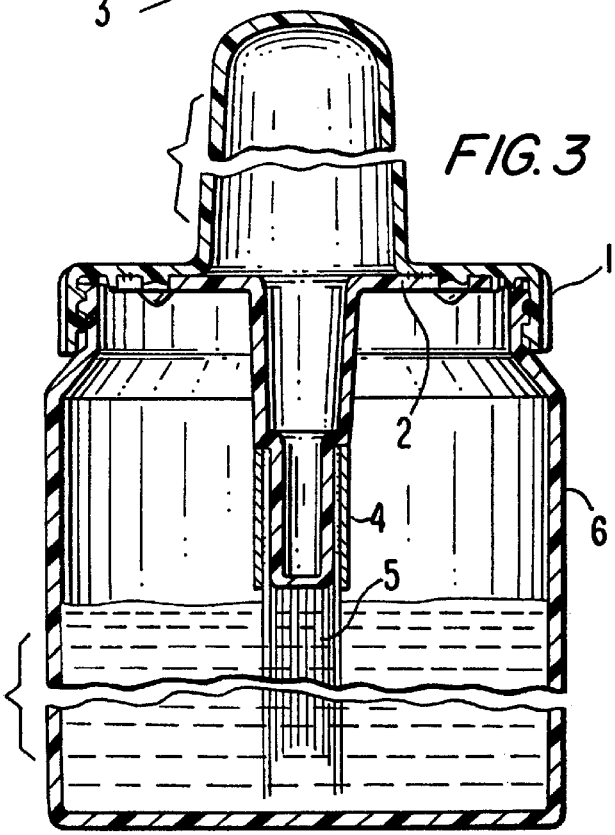
FIG. 3 shows the invention as assembled and containing a tire cleaning solution.

FIG. 3 is a cutaway view of the invention showing the container closed and containing a tire cleaning solution.

It is to be understood that the above described embodiments are merely illustrated and variations may be made without departing from the scope of the invention.

I claim:

1. A brush/container combination for use in cleaning tires, comprising a round handle connected to a container cover, said container cover having a plurality of protrusions on its lower side, a sealing disk having a plurality of apertures to mate with said protrusions, said sealing disk having a tongue portion affixed to its lower side, a collar portion which attaches to said tongue portion and to a brush portion to affix said brush portion to said tongue portion, and a container to which said container cover is releasably attached.

* * * * *

UNITED STATES PATENT AND TRADEMARK OFFICE

CERTIFICATE OF CORRECTION

PATENT NO. : 6,190,075 B1
DATED : February 20, 2001
INVENTOR(S) : Edward Lewis

It is certified that error appears in the above-identified patent and that said Letters Patent is hereby corrected as shown below:

Please change the inventor's address from:
1600 Topping Avenue, #3G, Bronx, New York, 10457
to:
1660 Topping Avenue, #3G, Bronx, New York, 10457

Signed and Sealed this

Thirtieth Day of October, 2001

*Attest:*

Nicholas P. Godici

NICHOLAS P. GODICI
*Acting Director of the United States Patent and Trademark Office*

*Attesting Officer*